United States Patent [19]

Pritchett

[11] 3,948,319

[45] Apr. 6, 1976

[54] METHOD AND APPARATUS FOR PRODUCING FLUID BY VARYING CURRENT FLOW THROUGH SUBTERRANEAN SOURCE FORMATION

[75] Inventor: William C. Pritchett, Plano, Tex.

[73] Assignee: Atlantic Richfield Company, Los Angeles, Calif.

[22] Filed: Oct. 16, 1974

[21] Appl. No.: 515,205

[52] U.S. Cl. ..... 166/248; 166/245

[51] Int. Cl.[2] ..... E21B 43/24

[58] Field of Search ..... 166/248, 302, 245

[56] References Cited

UNITED STATES PATENTS

| | | | |
|---|---|---|---|
| 2,799,641 | 7/1957 | Bell | 166/248 |
| 2,801,090 | 7/1957 | Hoyer et al. | 166/248 |
| 3,605,888 | 9/1971 | Crowson | 166/248 |
| 3,642,066 | 2/1972 | Gill | 166/248 |
| 3,696,866 | 10/1972 | Dryden | 166/248 |
| 3,757,860 | 9/1973 | Pritchett | 166/248 |
| 3,782,465 | 1/1974 | Bell et al. | 166/248 |
| 3,848,671 | 11/1974 | Kern | 166/248 |
| 3,862,662 | 1/1975 | Kern | 166/248 |

*Primary Examiner*—Stephen J. Novosad
*Attorney, Agent, or Firm*—Ronnie D. Wilson

[57] ABSTRACT

Method and apparatus for heating a subterranean formation in which a plurality of wells are completed in a predetermined pattern, characterized by heating the subterranean formation by electrical conduction under conditions such that the electrical current flowing at different subterranean points in the subterranean formation, or adjacent thereto, varies at different times because of different current flow patterns to attain a more nearly uniform heating of the subterranean formation. Also disclosed are a plurality of methods and apparatus, including the preferred embodiments of this invention.

10 Claims, 10 Drawing Figures

SINGLE PHASE CURRENT PATTERN

3 PHASE I SOURCE

8 PHASE I SOURCE

METHOD AND APPARATUS FOR PRODUCING FLUID BY VARYING CURRENT FLOW THROUGH SUBTERRANEAN SOURCE FORMATION

BACKGROUND OF THE INVENTION

1. Field of the Invention

This invention relates to a method of and apparatus for heating subterranean formations. In another aspect, this invention relates to an improvement in method and apparatus for recovering a fluid from a subterranean formation by heating.

2. Description of the Prior Art

Uniform heating of a subterranean formation has yet to be achieved in the art. The achievement of this goal has been hindered principally by the fact that one can only enter a formation at discrete points. Thus, limited access to a formation has prevented those skilled in the art from uniformly heating a subterranean formation. The present invention provides a method and apparatus for achieving a more nearly uniform heating of a subterranean formation than was heretofore known.

A wide variety of fluids are recovered from subterranean formations. These fluids range from steam and hot water geothermal wells through molten sulfur to hydrocarbonaceous materials having greater or lesser viscosity. The hydrocarbonaceous materials include such diverse materials as petroleum, or oil; bitumen from tar sands; natural gas; and kerogen, a substance found in oil shales.

The most common and widely sought fluid to be produced from a subterranean formation is petroleum. The petroleum is usually produced from a well or wells drilled into a subterranean formation in which it is found. A well is producing when it is flowing fluids. The words "to produce" are used in oil field terminology to mean to vent, to withdraw, to flow, etc., pertaining to the passage of fluids from the well.

There are many hydrocarbonaceous materials that cannot be produced directly through wells completed within the subterranean formation in which the fluids are found. Some supplemental operation is required for their production. At least three such materials are kerogen in oil shale, bitumen in tar sands, and highly viscous crude oil in oil-containing formations. The first two frequently involve special production problems and require special processing before a useful product can be obtained. These materials have at least one common characteristic, however. That is, heat can bring about the necessary viscosity lowering, with or without conversion of the in situ product, to enable the hydrocarbonaceous material to be produced from its environment.

Several processes supplying heat in situ have been developed in the past. These processes employ so-called in situ combustion, fire flood, stream flood, or similar related recovery techniques in which at least one fluid containing or developing the heat is passed through the formation. Because of "liquid blocking" the usual methods of in situ heating which require injection of a fluid are often ineffective with the three materials discussed previously.

Liquid blocking is simply the building up of a bank of liquid hydrocarbonaceous material and water in advance of the front of the fluid being injected, combustion front, or the like. With this liquid build-up, permeability is dramatically reduced and excessively high pressures become necessary for continued injection at the high rates desired. A wide variety of techniques have been attempted in order to cure, or minimize, this problem; but to date they have not been totally successful.

Regardless of whether or not a fluid is injected into the formation, production is enhanced and liquid blocking minimized if the viscosity of the fluid can be reduced by heating. One of the problems encountered in pre-heating a subterranean formation has been that it tends to channel the heat along crevices or regions of greater permeability to create nonuniform, or extremely variable heating effects that contribute to premature breakthrough of any supplemental recovery operation. Heating more uniformly a subterranean formation containing the fluid not only helps alleviate the problem with liquid blocking, but can convert the liquid block to an asset that will tend to average minor permeability inhomogeneities, achieve increased macroscopic sweep efficiency of any fluid injected and improve the recovery of any such recovery operation subsequently initiated.

Thus, the prior art processes have not been successful in providing method and apparatus for heating a subterranean formation substantially uniformly throughout a predetermined pattern without requiring the injection of one or more fluids for effecting the heating in situ.

SUMMARY OF THE INVENTION

Accordingly it is an object of this invention to provide a method of heating a subterranean formation by electrical conduction substantially throughout a predetermined formation pattern intermediate a plurality of wells to thereby obviate the disadvantages of the prior art and provide the features delineated hereinbefore which have not been satisfactorily provided heretofore.

A further object of this invention is to provide a method of producing one or more fluids from a subterranean formation by substantially uniformly heating throughout a predetermined pattern of the subterranean formation without requiring the injection and passage through the formation of a fluid.

These and other objects will become more apparent from the following descriptive matter, particularly when taken in conjunction with the drawings and the appended claims.

In accordance with this invention, method and apparatus are provided for heating a subterranean formation by a multi-step process. First, a plurality of wells are drilled into and completed within a subterranean formation from the surface of the earth in a predetermined pattern. Respective electrical conductors, including electrodes, are emplaced in the wells and connected electrically with the subterranean formation and a source of current at the surface. Thereafter, the subterranean formation is heated by electrical conduction under conditions such that the electrical current flowing at different subterranean points varies at different times because of different current flow patterns induced, to attain more nearly uniform heating of the subterranean formation within the predetermined pattern of the wells. The electrical conductivity may be as a result of direct current flowing from one electrode to another under a given electromotive force, or voltage potential. On the other hand, the electrical conduction may be effected as a result of alternating current flow through the subterranean formation between respective electrodes. With either direct or single phase current sources, the current flows through the same areal portion of the subterranean formation over a period of time with the switching being effected, manually or automatically, at the surface by switching means.

In one embodiment of this invention, a multi-phase alternating current is flowed through the formation intermediate a plurality of at least three electrodes. The electrodes and multi-phase current source are connected in one or more predetermined multi-phase configurations such that the electrical current changes as the phase voltages change on the respective electrodes. With the multi-phase current sources, the current flows through an areal portion of the subterranean formation for a period of time.

Fluid may be produced to the surface through the respective production wells as the fluids migrate thereto, alone or under the influence of induced pressure gradients.

DESCRIPTION OF PREFERRED EMBODIMENTS

Figure 1:
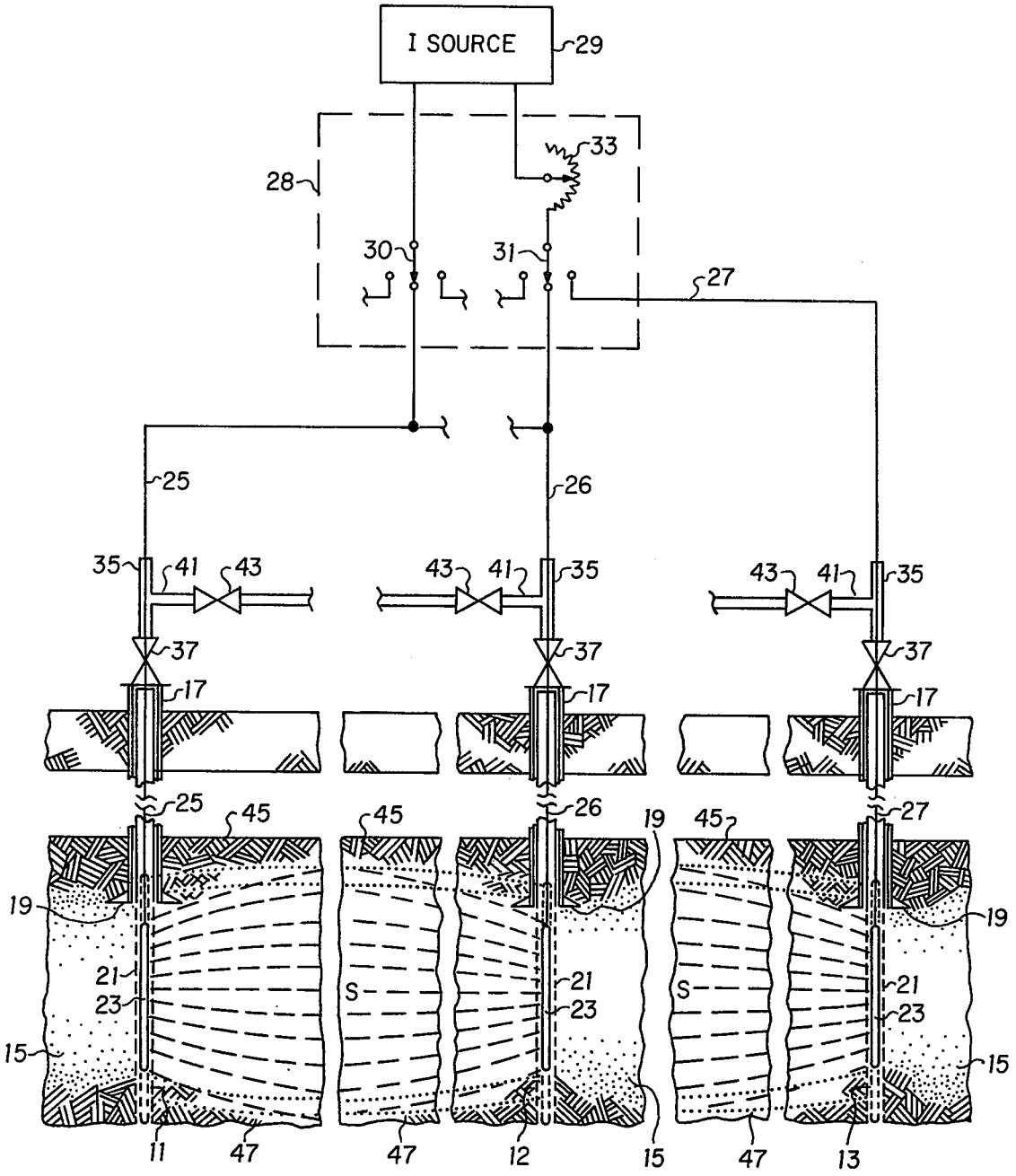
FIG. 1 is a side elevational view, partly schematic and partly in section, illustrating one embodiment of this invention.
Figure 2:
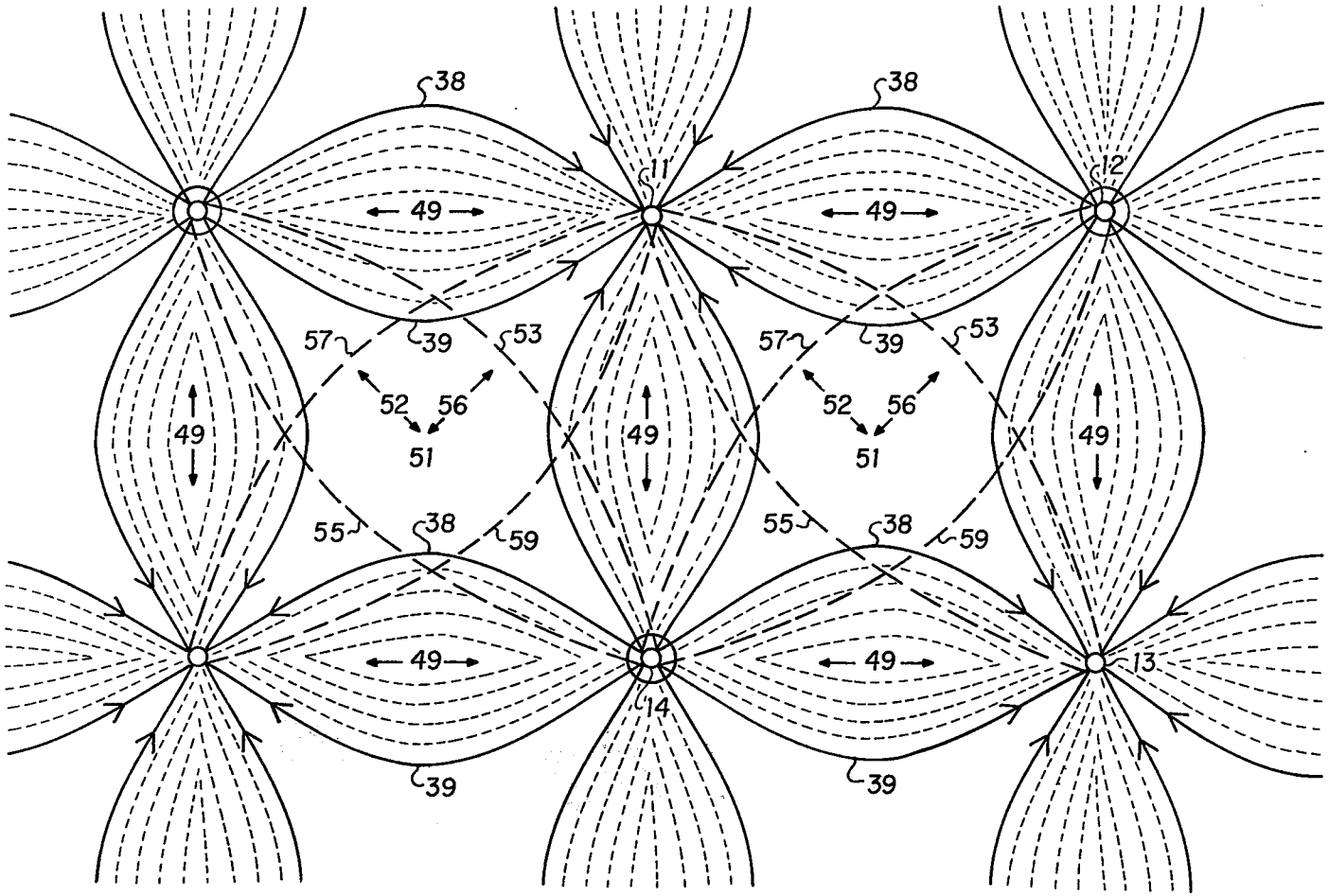
FIG. 2 is a plan view of a typical pattern carried out in accordance with the embodiment of FIG. 1.

Referring to FIGS. 1 and 2, a plurality of wells 11–14 are drilled into and completed within the subterranean formation 15, FIG. 1. As illustrated, a square pattern of wells is employed in each pattern. A pair of patterns are illustrated in FIG. 2.

Each of the wells has a string of casing 17 that is inserted in the drilled borehole and cemented in place with the usual foot 19. A perforated conduit 21 extends into the subterranean formation 15 adjacent the periphery of the borehole drilled thereinto. Preferably, the perforated conduit 21 includes a lower electrically insulated conduit for constraining the electrical current flow to the subterranean formation 15 as much as practical. The perforated conduit 21 may be casing having the same or different diameter from casing 17, or it may be tubing inserted through the casing 17. As illustrated, the perforated conduit 21 comprises tubing large enough for insertion therethrough of the electrodes and electrical conductors; but small enough to facilitate production of the fluids therethrough.

Each of the wells has an electrode 23. Respective electrodes 23 are connected via electrical conductors 25–27 with surface equipment 28. The surface equipment 28 includes suitable controls that are employed to effect the predetermined current flow. For example, respective switches 30 and 31 and voltage control means, such as rheostat 33, are illustrated for controlling the duration and magnitude of the current flow between the electrodes 23 in the wells 11–14 by way of the subterranean formation 15. It is preferred that a current (I) source 29 be adjusted to provide the correct voltage for effecting the desired, or predetermined, current flow through the subterranean formation 15 without requiring much power loss in surface control equipment exemplified by rheostat 33. The respective electrodes and electrical conductors are emplaced in their respective wells by conventional means. As illustrated, they are run through lubricators 35 in order to allow alternate or simultaneous heating and production; without having to alter the surface accessories; such as, changing the configuration of the well head 37, with its valves and the like. The respective electrodes are also electrically connected with the subterranean formation 15; for example, with a metallic conductive conduit 21; by maintaining an electrolyte intermediate the electrode 23 and the formation 15, or both.

As illustrated, the wells are connected with production facilities by way of suitable respective conduits 41, including respective valves 43. The production facilities are those normally employed for handling the fluids and are not shown, since they are well known in the respective art for the particular fluids being produced. For example, the production facilities may include the conventional facilities for producing petroleum, condensate, and/or natural gas; or the more elaborate facilities necessary for producing and converting kerogen of oil shale or bitumen of tar sands. The respective production facilities are discussed in greater detail in standard reference texts; such as, the KIRK-OTHMER ENCYCLOPEDIA OF CHEMICAL TECHNOLOGY, Second Edition, Anthony Standen, Editor, Interscience Publishers, New York, 1969; for example, Vol. 19, pages 682–732, contains a description of the production and processing of bitumen from tar sands. Since these production and processing facilities are well known and do not, per se, form a part of this invention, they are not described in detail herein.

OPERATION

In operation, the wells are completed in a subterranean formation 15 in accordance with conventional technology. Specifically, boreholes are drilled, at the desired distances and patterning, from the surface into the subterranean formation 15. Thereafter, the casing 17 is set into the well and formation to the desired depth. As illustrated, the casing 17 may comprise a surface string that is cemented into place immediately above the subterranean formation 15. Thereafter, the string of tubing, including an insulated perforated conduit 21, is emplaced in the respective boreholes and completed in accordance with the desired construction. For example, the perforated conduit 21 may be cemented in place, or it may be installed with a gravel pack or the like to allow for expansion and contraction and still secure the desired productivity.

In any event, the electrodes 23 are thereafter placed in the respective wells. The formation 15 may range in thickness from only a few feet to as much as 50 or 100 or more feet. The electrodes will have commensurate length ranging from a few feet to 50 or 100 or more. The electrodes 23 are continuously conductive along their length and are electrically connected with the subterranean formation 15 as described hereinbefore and with the respective electrical conductors 25–27 by conventional techniques. For example, the electrodes 23 may be of copper-based alloy and may be connected with copper-based conductors 25–27 by suitable copper-based electrical connectors. Thereafter, the current source 29 is connected with the conductors 25–27, or with as many such electrical conductors as are needed to supply all of the wells, by way of the surface equipment 28. If the desired current densities are obtainable without the use of the rheostat, it is set on zero resistance position to obtain the desired current flow between the wells.

The electrical current will flow primarily through the subterranean formation 15 when the electrodes 23 are emplaced therewithin, although some of the electrical current will flow through contiguous formations, such as the impermeable shales 45 and 47, FIG. 1, above and below the formation 15. Voltage and current flow are adjusted to effect the desired gradual increase in temperature of the formation 15 and the fluid therewithin without overheating locally at the points of greatest current density, as indicated hereinafter. For example, the current may be from a few hundred to 1,000 or more amperes between the electrodes 23 in the adjacent wells. The applied voltage may be from a few hundred volts to as much as 1,000 or more.

Since there will be a high current density immediately adjacent each of the electrodes 23, the temperature will tend to increase more rapidly in this area. The current that flows through the formation 15 to heat the formation and the fluid therewithin frequently depends on the connate water envelopes that surround the sand grains or the like. Accordingly, the temperatures in the regions of highest current density; for example, in the regions immediately about and adjoining the wells must not be so high as to cause evaporation of the water envelopes at the pressure that is sustainable by the overburden. Expressed otherwise, the predetermined electrical current is maintained low enough to prevent drying of the subterranean formation 15 around the respective wells. It may be desirable, however, to inject at least periodically a small amount of electrolyte around each of the wells in order to keep the conductivity high in this region if conductivity tends to be reduced for any reason.

The electrical current will flow primarily along the shortest path through the subterranean formation 15 between the respective electrodes in adjacent wells having the voltage differential therebetween. For example, in FIG. 2, the primary electrical conduction will occur within the area 49 bounded by the lines 38 and 39 when the voltage differential exists between adjacent wells, such as wells 11 and 12. Consequently, when the respective electrodes are connected in a first configuration that supplies such a voltage differential, the respective areas 49 will be heated by the electrical current flow between adjacent wells.

Outside the areas 49, large second areas 51 are heated less by the primary electrical current flow when the electrodes are connected in the first configuration to conduct between adjacent wells. This is true regardless of whether the current source is a direct current source effecting a direct current flow in one direction between predetermined wells; or a single phase alternating current flow effecting current flow between adjacent wells.

The pre-heating of the areas 49 of the formation and the fluid therewithin is continued until a desired time period has elapsed or a desired temperature is reached in the heated area 49 where the primary current flow occurs. The desired time period for pre-heating can be a period of only minutes but may be in excess of weeks or even months.

After the desired temperature has been reached, or the areas 40 have been heated for a predetermined time period, the configuration of the voltage differential between wells is altered to a second configuration. This second configuration is effected by suitable switching apparatus in the surface equipment 28. Referring to FIG. 1, the switching may be illustrated by the movement of the switch 31 to connect the electrical conductor 27 with the rheostat 33 such that the voltage differential exists between diagonal wells, such as wells 11 and 13 in FIGS. 1 and 2. With such a simplified schematic arrangement, the primary current flow will be along the path defined by the area 52 intermediate the dashed lines 53 and 55. Consequently, most of the area 51 will be further heated by the second configuration.

If desired, a third configuration may be effected in which the primary current flows through the area 56 intermediate the lines 57 and 59. The third configuration is illustrated by having the oppositely diagonal wells, such as wells 12 and 14, connected with the respective voltage differential therebetween. The respective first, second and third configurations may be effected at different times such that the heating between the respective wells involved is carried out over long time intervals.

If desired, the voltage differentials intermediate the diagonally opposed wells may be increased by a suitable proportion, such as by the factor $\sqrt{2}$, to provide substantially the same current density through the respective areas intermediate the delineated lines.

In any event, the pre-heating of the formation, and the fluid therewithin is continued until the desired temperature is reached. Thereafter, the desired production operation is carried out, flowing the fluids to the wells through which they will be produced to the surface. If desired, auxiliary pumping equipment, such as downhole pumps, may be employed to produce the fluids to the surface. Usually, however, where a fluid is injected into one or more of the wells serving as an injection well, suitable pressure differentials will be established to produce the fluid to the surface through the production wells without using auxiliary pumping equipment.

It will be appreciated that the time for heating the subterranean formation may be shortened if means are provided for effecting the respective first, second and third, as well as other, configurations with less time lost when there is no current flowing through certain areal portions of the subterranean formation. This desirable result can be achieved by the use of a multi-phase alternating current source and connecting the respective electrodes 23 in the respective wells to the respective phase leads from the multi-phase current source, with or without a neutral voltage lead.

Figure 3A:
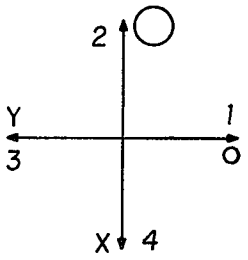
FIG. 3A is a vector diagram of the four phase current employed in FIG. 3.
Figure 3:
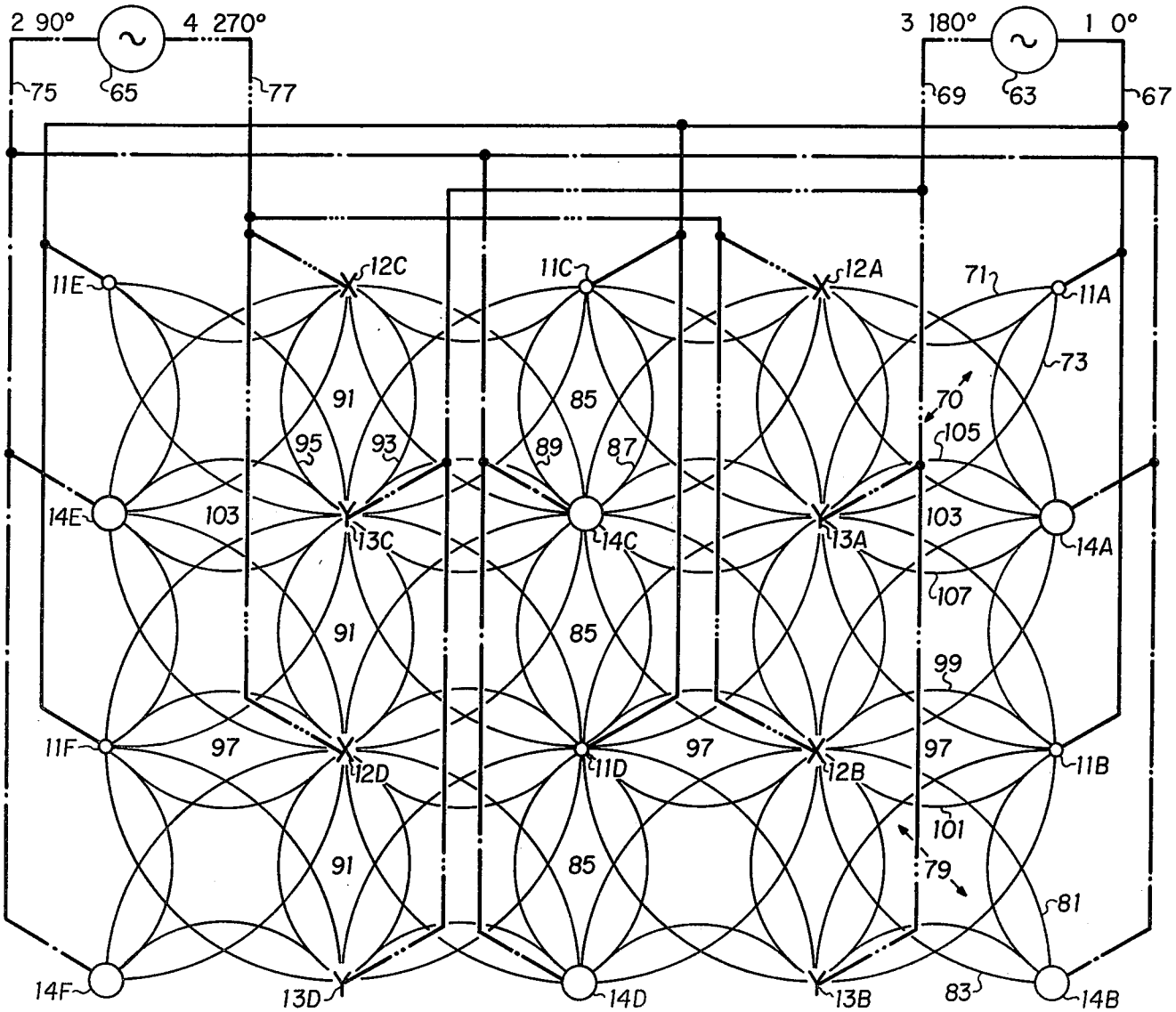
FIG. 3 is a schematic plan view of another embodiment of this invention employing four phase current for the electrical conduction.

A satisfactory embodiment of this invention employing multi-phase current flow is illustrated schematically in FIG. 3. Therein, two generators 63 and 65 have their respective leads connected with respective diagonally opposed wells in the pattern of wells. The voltage of the leads are 90° out of phase with respect to each other, as illustrated in FIG. 3A. Specifically, the generator 63 has its lead 67, representing phase 1, the relative 0° phase, connected with the wells marked with a little circle (o). These wells are arbitrarily designated 11A-F in FIG. 3. The generator 63 has its lead 69, representing phase 3, the relative 180° phase, connected with the wells marked with a Y. These wells are designated 13A-D. The horizontal vectors of FIG. 3A, representing the O° and 180° phase voltages, are illustrated with phase numerals 1 and 3 and the respective well symbols *o* and Y at the ends of the vectors for explanation of amplitudes of the voltage vector differences hereinafter.

The generator 65 has its lead 75, representing phase 2, the relative 90° phase, connected with the wells marked with a large circle (O). These wells are designated 14A-F. The generator 65 has its lead 77, representing phase 4, the relative 270° phase, connected with the wells marked X. The wells marked X are arbitrarily designated 12A-D.

Figure 3B:
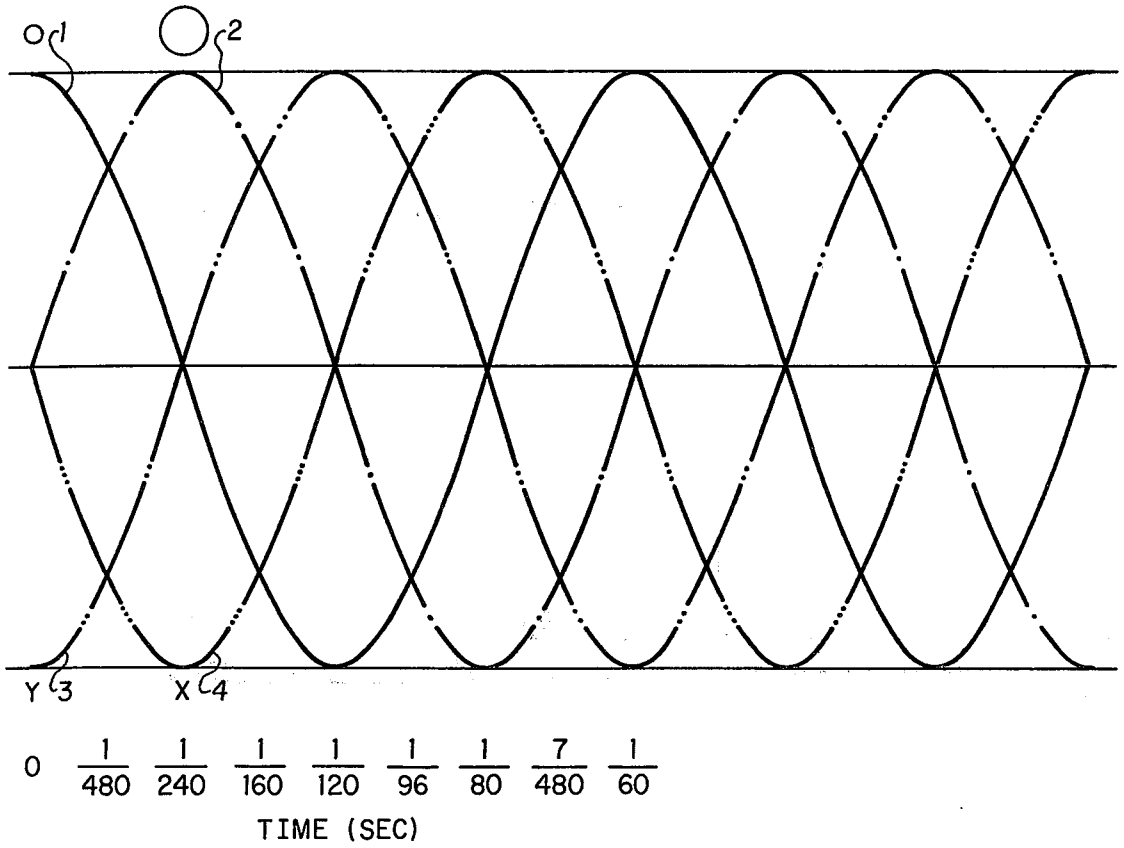
FIG. 3B is a conventional sine wave representation of the four phase current employed in the embodiment of FIG. 3.

Those skilled in electrical engineering will readily appreciate the rapidly changing diverse voltage differential and current flow patterns in the subterranean formation 15 intermediate the configuration of electrodes connected with the respective four phase leads. Ordinarily, the phase peak voltages will change on the phase leads several times per second; e.g. the current may be 60 Hertz, or 60 cycles per second. To ensure reader understanding, a brief description is given of a cycle; for example, over an arbitrarily selected 1/60 of a second as illustrated in FIG. 3B. The descriptive matter is given with respect to discrete relative times from time zero and describes selectively and schematically in a simplified way the respective patterns heated within the subterranean formation 15.

Referring to FIG. 3B, the maximum voltage differential at zero time is between phases 1 and 3. If the amplitude of each voltage on each lead be arbitrarily assigned a relative value of unity, or 1, the voltage difference will be additive, or 2, as shown in FIGS. 3A and 3B. The phase 1 and 3 leads are leads 67 and 69. The leads 67 and 69 are connected with electrodes in wells 11A-F and 13A-D. The wells 11 and 13 are diagonally opposed wells in the pattern. If the distance between adjacent wells be assigned a unit (1) distance, the wells 11 and 13 are separated a distance of 1.414. The ratio of voltage differential to distance (voltage/distance) is 2.0/1.414. Referring to FIG. 3, during the instant in time when the voltage differential is at a maximum between wells 11 and 13, the primary current flow will be through the area 70 intermediate the lines 71 and 73 and wells 11A and 13A to heat the area portion 70 of the reservoir 15 and the fluids therewithin. This phase passes rapidly, and by 1/480 of a second later the phase voltages have shifted, as shown in FIG. 3B.

The voltage differential between phases 1 and 3 will have decreased to a relative amplitude, or magnitude, of 1.414. The same magnitude voltage differential also exists between phases 1–4, 2–3 and 2–4. The latter is increasing, is between diametrically opposite wells 12 and 14 having a voltage/distance ratio of 1.414/1.414, and will be discussed later hereinafter when the voltage differential therebetween reaches a maximum.

The voltage/distance between the respective pairs of phase leads 1–4 and 2–3 is 1.414/1.0. Consequently, the voltage differentials between these phase leads are the predominant voltages influencing the current flow patterns at this instant and will be considered next.

The voltage differential that exists between the phase 1 and 4 leads will be discussed first. In FIG. 3 the phase 1 and 4 leads are leads 67 and 77, respectively. The leads 67 and 77 are connected with electrodes in the wells 11A-F and 12A-D. The wells 11 and 12 are adjacent wells in the illustrated pattern. Consequently, the distance between the adjacent wells 11 and 12 is an arbitrary unit 1 distance, hence the voltage/distance ratio of 1.414/1.0. The voltage differential between wells 11 and 12 causes primary current flow through the area 97 defined intermediate the lines 99 and 101. This flow path is illustrated between the wells 11B-12B; 12B-11D; and 11D-12D, inter alia.

Simultaneously, the same voltage differential exists between the phase leads 2 and 3. The phase 2 and 3 leads are leads 75 and 69, respectively. The leads 75 and 69 are connected with electrodes in the wells 14A-F and 13A-D. The wells 13 and 14 are separated by a unit distance, similarly as with wells 11 and 12. Consequently, the voltage/distance ratio will be 1.414/1.0, as indicated hereinbefore. The voltage will be such as to cause current to flow between the wells 13 and 14, primarily through the area 103 defined by the lines 105 and 107. This areal heating is represented between wells 14A–13A; 13A–14C; and 14C–13C, inter alia. The current and flow patterns shift rapidly.

A short interval 1/480 of a second later, or 1/240 or a second from time zero, the maximum voltage differential exists between the phase leads 2 and 4. The phase leads 2 and 4 are, respectively, leads 75 and 77. The leads 75 and 77 are connected, respectively, with electrodes in the wells 14A-F and 12A-D. Thus, as illustrated in FIGS. 3A and 3B, the leads 75 and 77 afford a maximum voltage amplitude of 2.0 between the ends of vectors, representing electrode voltages in the diagonally opposite wells 12–14. The wells 12–14 are separated by a relative distance of 1.414. The voltage/distance ratio is 2.0/1.414. For clarity, the respective areas of primary current flow and heating between the wells 12–14 will be described with respect to the lower right hand corner of FIG. 3. It is to be realized, of course, that this effect is imposed between all of the wells 12–14, but describing it with respect to such superimposed areas would make more difficult comprehension of the effect. Specifically, the primary current flow between the wells 12–14 will be through the area 79 defined intermediate the lines 81 and 83 and wells 14 and 12; for example, wells 12B–14B; during the instant of the peaking of the amplitude difference between the phase 2 and 4 voltages. The phase voltages shift rapidly.

A short interval of 1/480 of a second later, or 1/160 of a second from time zero, the voltage differential between phase 2 and 4 leads will have decreased to a relative voltage of 1.414. The voltage differential across the phase 3–1 leads will have increased to 1.414 also and will be described later hereinafter when they again assume a predominant role in influencing the current flow pattern. At this time, the same relative voltage differential of 1.414 exists between phase leads 2–1 and phase leads 3–4. These leads are connected with electrodes in wells that are, in turn, connected with the formation 15 at more closely spaced points. Consequently, the effect of these voltage differentials will be described.

The phase leads 2 and 1 are, respectively, leads 75 and 67. The leads 75 and 67 are connected with electrodes in the wells 14A–F and 11A–D. The wells 11 and 14 are vertically adjacent wells separated by a unit distance. Consequently, the voltage/distance ratio is 1.414/1.0. The voltage differential during this short interval of time will effect a primary flow of current through the area 85 defined intermediate the lines 87 and 89 and intermediate the wells 11 and 14. The area 85 is illustrated between wells 11C–14C, 14C–11D, 11D–14D. Again, it is to be realized that this areal heating is superimposed onto and overlaps the other respective areas, such as areas 70 and 79 intermediate the diagonally opposed wells 11–13 and 12–14.

Simultaneously, a relative voltage differential of 1.414 exists intermediate phase leads 3 and 4. The phase leads 3 and 4 are, respectively, leads 69 and 77. The leads 69 and 77 are connected with the electrodes in the wells 13A-D and 12A-D. The wells 12 and 13 are vertically adjacent wells having a unit distance separation. Consequently, the voltage/distance ratio is 1.414/1.0. The voltage between wells 12 and 13 causes a current to flow primarily through the area 91 defined between the lines 93 and 95. Such a heating within the area 91 is illustrated between wells 12C–13C; 13C–12D; and 12D–13D. It is to be realized, of course, that the area 91 is superimposed onto the other heated patterns such that there is overlapping of the areal extent of current flow and heating with respect to the other areas, such as areas 70 and 79.

At one-half of the cycle, the previously discussed voltage differentials begin to repeat themselves but with reversed polarity, as is conventional with an alternating current source. Specifically, at 1/20 of a second from time zero, the maximum voltage differential exists between voltage leads 3–1, the same voltage differential but with opposite polarity from the time zero voltage differential between phase leads 1–3. As a consequence, the same wells and the same area of the subterranean formation 15 are heated although the direction of current flow is reversed. Similarly, at 1/96 of a second from time zero, the voltage differential between phase leads 3–1 is decreasing while the voltage differential between phase leads 4–2 is increasing; but the predominant voltage influence with a voltage/distance ratio of 1.414/1.0, exists between the respective electrodes in the wells connected with the respective phase leads 4–1 and phase leads 3–2, as delineated hereinbefore. It will be seen that the voltage differentials are the same in magnitude but of opposite polarity from that occurring at the time interval 1/480 of a second from time zero. Consequently, the same two areas intermediate the same sets of wells are heated, even though the voltage differential is of opposite polarity and the current flow is opposite in direction.

Similarly, at 1/80 of a second from time zero, the maximum voltage differential occurs between phase leads 4-2. This is opposite the polarity, although the magnitude is the same, of that occurring at 1/240 of a second from time zero. Consequently, the same area of the subterranean formation is heated although the direction of current flow is opposite.

By similar analogy, the voltage differential and the current flow patterns occurring at 7/480 of a second is the same as that occurring at 1/160 of a second, although the polarity is reversed. Consequently, the same area portions of the reservoir are heated by the electrical current flow, although the direction of the current flow is opposite.

At the time interval of 1/60 of a second from time zero, an entire cycle will have been completed and the voltage phase, current flow patterns and heating patterns are repeated.

Thus, it can be seen that the discrete analysis is complicated. In practice, however, the four phase current flows more nearly uniformly to achieve more nearly uniform heating throughout the subterranean formation than does the single phase current flow. Moreover, it can be seen that at the respective points, such as within the areas 70, 79, 85, 91, 97, and 103, the amplitude and direction of current flow changes at different times as the phases change on the respective phase leads and electrodes within the respective wells.

The areas are superimposed onto the respective other heated areas. It is fortuitous that although the primary current flow may be through the central portion of an area, there is repeated heating of the peripheral portions of an area because of this overlapping of the patterns.

It must be kept in mind, of course, that the schematic representations of the current flow do not represent actual physical phenomena. In fact, the flow of current is much more diffuse and a little current flows even over the very circuitous routes.

Once the heating has been carried out by electrical conduction through the four phase current flow, the recovery operation can be carried out, producing the heated fluid through the respective production wells by conventional means or method steps, similarly as described with respect to FIGS. 1 and 2 hereinbefore. The conventional means, as indicated, may include conventional downhole pumping equipment; the injection of one or more fluids to create pressure differentials toward the production wells, or both.

A multi-phase current source having either a lesser number or a greater number of phases can be employed in this invention. For example, current sources employing three and eight phases are described hereinafter.

Figure 4A:
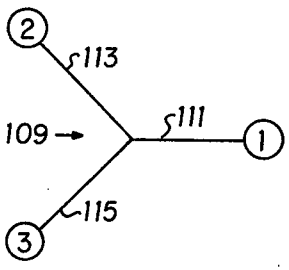
FIG. 4A is a vector diagram of the three phase current employed in FIG. 4.
Figure 4:
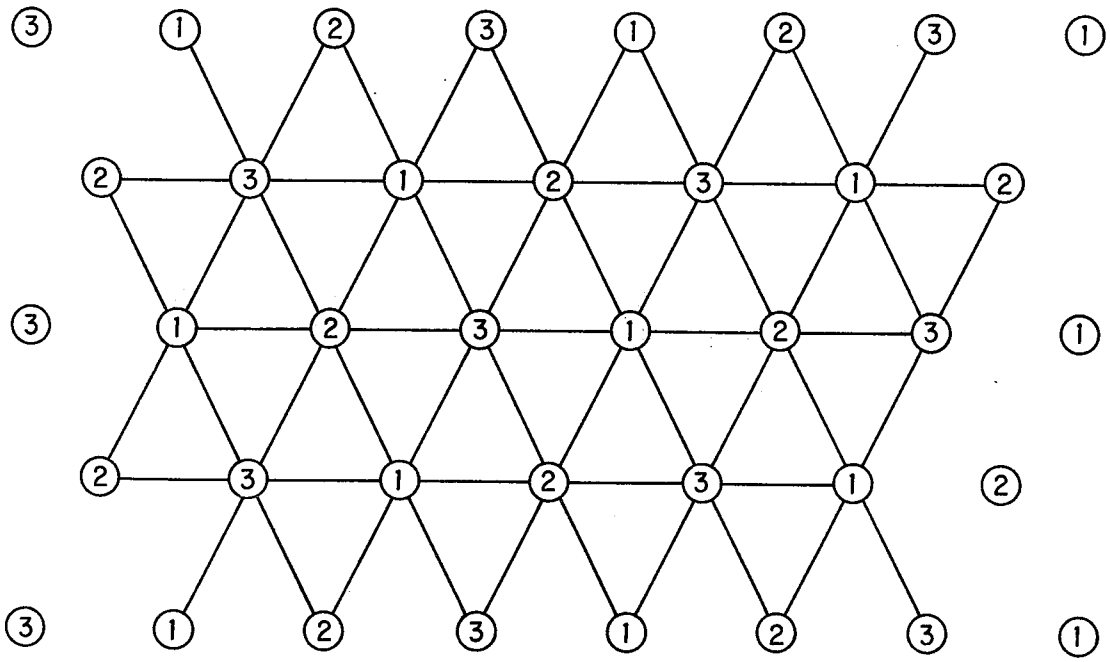
FIG. 4 is a schematic plan view of still another embodiment of this invention employing three phase current for the electrical conduction.

A typical configuration for employing a three phase current source with the respective three phase leads being connected via electrical conductors with electrodes in the wells is illustrated schematically in FIG. 4. The wells therein are drilled three wells to a pattern so as to provide a triangular pattern for use with the three phase current source 109. For example, the electrodes in wells designated 1 are connected with the phase 1 lead 111; the electrodes in wells designated 2 are connected with the phase 2 lead 113; and the electrodes in the wells designated 3 are connected with the phase 3 lead 115. The three phase current source 109 is illustrated as a vector diagram analogous to FIG. 3A for the four phase current source. If desired, sine wave representations of the respective three phases can be drawn, similar to FIG. 3B for the four phases. The same analytical procedures employed with respect to the embodiment of FIG. 3 will show the discrete voltage differentials and flow patterns. It is sufficient to note that the three phase current source 109, such as a three phase generator, imposes the respective voltage differentials between the respective wells in the pattern in the illustrated configuration to cause current flow patterns that vary the current passing predetermined subterranean points as the phase voltages on the respective electrodes change, similarly as described hereinbefore with respect to FIG. 3. Consequently, the subterranean formation is more nearly uniformly heated in the pattern intermediate the wells than it would be with single phase current or direct current connected to alternate electrodes. As indicated hereinbefore, after a suitable heating interval and the desired temperature has been reached in the formation, the fluids may be produced through the production wells by the conventional means described hereinbefore.

Figure 5A:
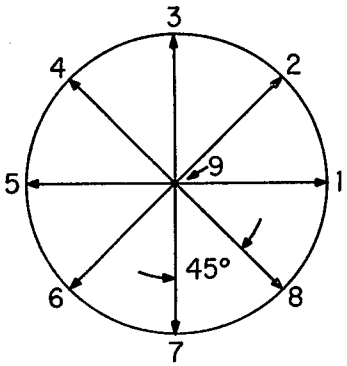
FIG. 5 is a schematic plan view and vector diagram of still another embodiment of this invention employing eight phase current for the electrical conduction.
Figure 6:
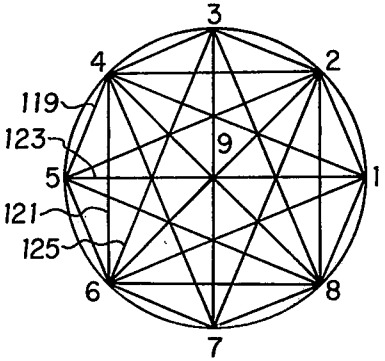
FIG. 6 is a diagram of the difference vectors for the magnitude of the respective maximum voltage differentials intermediate the respective phase leads and the electrical common, or neutral voltage, lead.
Figure 5:
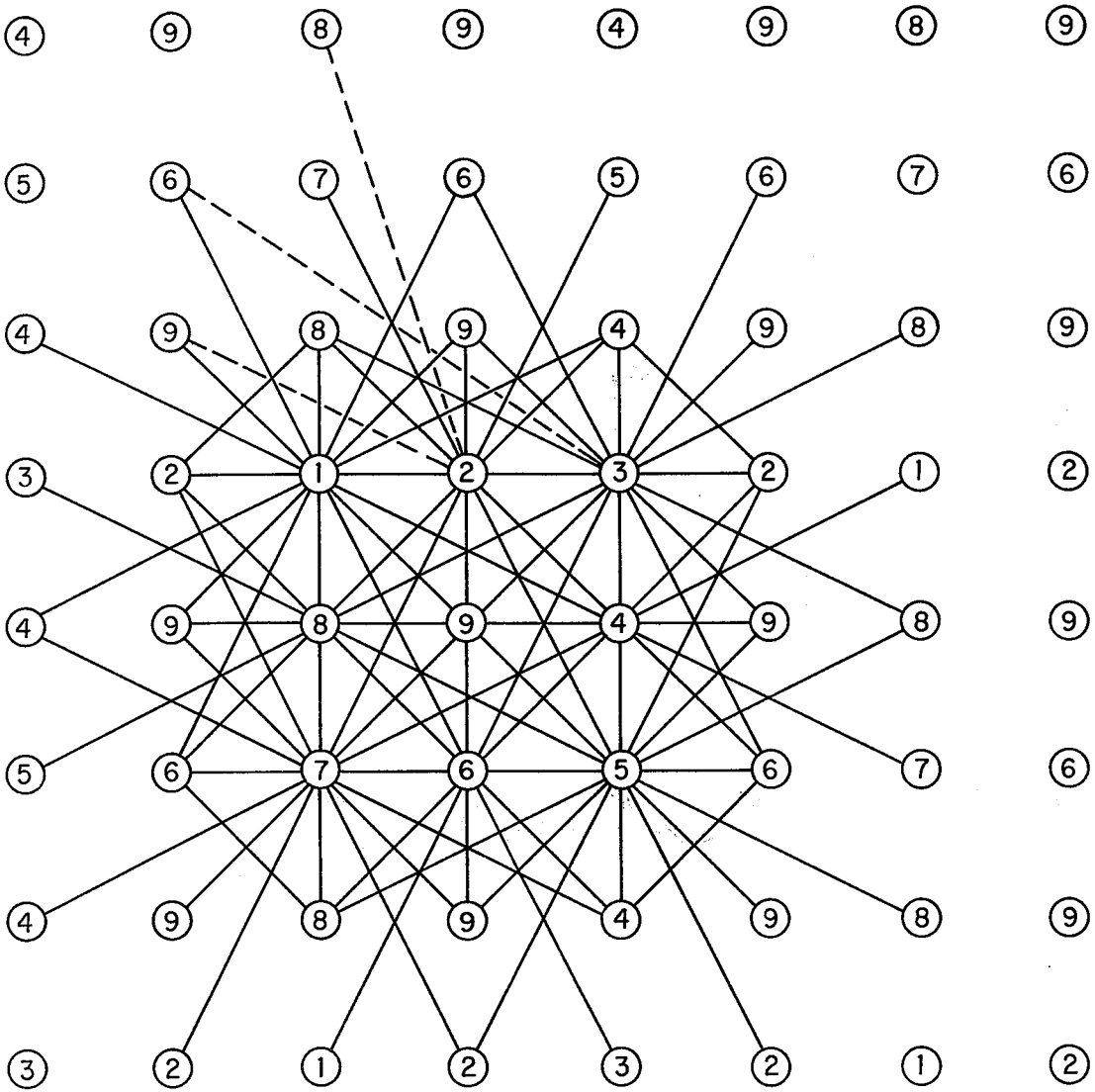

The eight phase configuration may be employed without an electrode connected to neutral voltage lead, or electrical common, similarly as described hereinbefore with respect to FIGS. 3 and 4 for the four phase and the three phase current sources. If desired, one of the electrodes may be connected with a neutral lead and that embodiment is illustrated in FIG. 5. Specifically, the wells numbered 1 through 9 are connected, respectively, with the eight phase leads given the same numbers in the eight phase current source 117 and with the ninth lead which is electrical common, or neutral voltage. Accordingly, as the eight phase current source generates the respective voltage phases, there will be created between the respective electrodes in the wells voltage differentials exemplified by the voltage difference vectors of FIG. 6. The eight phase current source is illustrated in FIG. 5A as a vector diagram analogous to FIG. 3A for the four phase current source. If desired, sine wave representations, analogous to the sine waves of FIG. 3B but incorporating eight sine wave lines, may be drawn for the respective eight phases. The respective sine waves, or phase voltages, are 45° out of phase with respect to an adjacent sine wave. The same analytical procedures employed with respect to the embodiment of FIG. 3 will demonstrate the variety of voltage amplitude relationships and their occurrence with respect to the respective electrodes and wells. The analysis of such a complex phase interrelationship configuration, as illustrated in FIG. 5, is complex, similarly as with the four phase relationship of FIGS. 3, 3A and 3B. The principles are the same, however, and the analysis is well understood in the electrical engineering art and may be carried out by one skilled in this art. A brief example can be seen with respect to FIG. 6. FIG. 6 shows the respective lines intermediate the numbers of the vector, or scalar, the representations of the magnitude of the voltage on the respective phase leads and neutral. In the figures, such as FIG. 5, the distances between the wells represents lateral, or horizontal distances in the subterranean formation and does not have any necessary bearing on the magnitude of the voltage existing between the electrodes in the respective wells. In FIGS. 5 and 6, the voltage potential and, consequently, current flow with a constant resistivity assumed, is illustrated by the line 119 between wells 4 and 5 for adjacent wells peripherally of a given pattern. In contrast, the maximum voltage potential existing between wells 4 and 6, or phases 4 and 6 in FIG. 6, is represented in amplitude, or magnitude, by the line 121. Accordingly, it can be seen that the diagonally opposed wells 4–6 have a greater voltage potential than do adjacent wells 4 and 5 or 5 and 6. Similarly, the diagonal potential between wells 5 and 9 is illustrated by the line 123. Again, it can be seen that the diagonally disposed wells have a greater voltage potential therebetween at the instant of maximum voltage differential therebetween. The doubly diagonally disposed wells, such as wells 3 and 6 will have an even greater voltage potential therebetween, as illustrated by the line 125, FIG. 6. Although there will be greater voltage differentials for effecting current flow along the greater distances between wells, the voltage to distance ratio will not necessarily be uniform. To illustrate the point, the voltage differential between well 9 and well 5 will be the same as the voltage differential between well 9 and well 4 at the maximum voltage differentials between the named wells at their respective instants of maximum voltage occurrence during the phase voltage changing, but the distances between wells are different. The voltage magnitude represented by the line 119 has a relative magnitude of 0.765 whereas the line 123 has a relative magnitude of 1.0. Expressed otherwise, the voltage between wells 9 and 4; for example, would have a relative magnitude of 1.0 at its maximum compared with a maximum voltage differential between wells 4 and 5 of only 0.765. The maximum voltage differential intermediate diagonally disposed wells, such as wells 4–6, represented by line 121, would have a relative voltage magnitude of 1.414. This is the same relationship as the relative distance between the wells which is 1.414 times the distance between adjacent wells in a square pattern. The distance between the doubly diagonally disposed wells, such as wells 3–6, has a relative distance magnitude of 2.24, whereas the relative voltage differential magnitude, represented by line 125, is only 1.847. It is sufficient to note at this point that the overlapping areal portions of the subterranean formation heated by the respective current flows intermediate the respective wells in the illustrated pattern as the phase voltages change in the eight phase current source, is sufficient to heat the formation more nearly uniformly than would electrodes disposed in alternate wells and connected with a constant voltage potential, such as a single phase current source or a direct current source.

As noted hereinbefore with respect to the other embodiments, after the subterranean formation and the fluids therewithin have been heated to a sufficiently high temperature, the recovery, or producing operation, may be begun.

The recovery operation is carried out with the conventional steps peculiar to the selected recovery operation. These steps need not be delineated carefully herein, since they are conventional.

GENERAL

The electrical heating may be stopped when the production is begun or it may be continued during the production operation as determined to be the most economically advantageous procedure. If desired, the recovery operation and the heating may be operated intermittently and alternately.

If desired, the respective configurations and multiphase current sources may be included in a certain portion of the field and the same or different configuration and multi-phase current source employed in another portion of a field, all in which the wells are completed in a given subterranean formation 15.

The usual precautions must be observed when employing high voltage leads from the respective multiphase current sources, particularly where electrolyte or the like is injected into the wells to maintain electrical conductivity low. The safety precautions are well documented for working with high voltages and need not be delineated in this already lengthy specification.

As indicated hereinbefore, any number of phases may be employed in a particular pattern or wells and the electrodes in the respective wells connected with the respective phase leads to achieve any desired configuration. For example, a six phase configuration, with or without the neutral voltage lead may be employed in conjunction with a hexagonal well patterning.

If desired, a combination of respective embodiments delineated hereinbefore may be employed. For example, direct current heating may be employed to heat a particularly more viscous portion of a subterranean formation simultaneously with an alternating current, multi-phase current source in the subterranean formation.

The respective multi-phase current sources may be provided by any conventional electrical engineering means. For example, two- or three-phase generators, or phase shifters on respective phases, may be employed. As illustrated in FIG. 3, the four phase current source comprises two generators connected with their phase leads 90° out of phase.

Moreover, the switching of the voltage differential configurations with respect to respective electrodes in the wells may be done by any means. As described hereinbefore, manual or automated switching of discrete switches and multi-phase switching has been employed. If desired, electronic switching with conventional large current and high voltage handling means, even including solid state devices, can be employed. For example, SCR's (silicon control rectifiers) can be employed to switch direct current voltage-electrode configurations to thereby shift the current flow patterns in the subterranean formation 15. If desired, motor driven mechanical switching may be employed in the surface equipment 28.

The rapidly changing phase voltages of a multi-phase current source cause even more nearly uniform current flow and heating than appears from the discrete time analyses delineated hereinbefore. Consequently, and as indicated hereinbefore, the use of multi-phase current is frequently advantageous in the practice of this invention.

From the foregoing, it can be seen that this invention achieves the objects delineated hereinbefore; and, specifically, provides method and apparatus for heating a subterranean formation without requiring the injection of a heat-producing fluid and the difficulties, such as liquid banking, attendant thereto. In contrast, the fluid and formation can be heated electrically such that if a fluid is subsequently injected, the more mobile heated fluids in the heated formation will flow more readily toward the producing wells. With this approach, the tendency to liquid bank results in effecting a more nearly uniform macroscopic sweep with improved areal sweep efficiency. Moreover, the more mobile fluid will be moved from its interstices in situ to effect a higher microscopic sweep efficiency by any injected fluid.

Although this invention has been described with a certain degree of particularity, it is understood that the present disclosure has been made only by way of example and that numerous changes in the details of construction and the combination and arrangement of parts may be resorted to without departing from the spirit and the scope of this invention.

What is claimed is:

1. A method of heating a subterranean formation which comprises completing a plurality of wells within said formation in a predetermined pattern, installing electrical conductors in said wells, connecting said electrical conductors with the formation and with voltages so as to effect electrical conduction through the formation between wells, and heating said subterranean formation by said electrical conduction under conditions such that the electrical current flowing at different subterranean points varies at different times because of different current flow patterns to attain more nearly uniform heating of said subterranean formation, said electrical conduction effected by a multi-phase current source and said wells in said predetermined pattern have respective predetermined arrangement of electrical conductors therein; and each respective electrical conductor is connected with a predetermined phase of said multi-phase current source and said current flow patterns vary as said voltage differential configurations vary with the phase voltage changes on said electrical conductors connected with the respective phase leads with time.

2. The method of claim 1 wherein three different electrical conductors are emplaced in a predetermined three phase configuration in said wells; said source of multi-phase current is a three phase current source; and each respective electrical conductor is connected with a predetermined phase of said three phase current source.

3. The method of claim 1 wherein four different electrical conductors are emplaced in a predetermined four phase configuration in said wells; said source of multi-phase current is a four phase current source; and each respective electrical conductor is connected with a predetermined phase of said four phase current source.

4. The method of claim 1 wherein said predetermined pattern of said wells includes nine wells; nine different electrical conductors are emplaced in respective said wells in an eight phase configuration; said source of multi-phase current is an eight phase current source and said electrical conductors are connected with, respectively, the neutral and the respective eight phase leads of said eight phase current source.

5. Apparatus for heating a subterranean formation comprising:

a. a plurality of wells extending from the surface of the earth to and completed within said subterranean formation in a predetermined pattern for producing said fluids;

b. a plurality of electrical conductors in respective said wells; each said electrical conductor being electrically connected with said subterranean formation for passage of current therethrough; and c. a multi-phase electrical current source having respective leads for each respective phase thereof; respective said leads being connected with respective said electrical conductors in a predetermined configuration so as to vary the electrical current flowing at different subterranean points in said subterranean formation at different times because of different current flow patterns to attain more nearly uniform heating of said subterranean formation by electrical conduction therethrough within said predetermined pattern of wells.

6. The apparatus of claim 5 wherein said multi-phase current source is a three phase source with at least three leads; said electrical conductors are connected with said at least three leads in a predetermined three phase configuration.

7. The apparatus of claim 5 wherein said multi-phase current source is a four phase current source having at least four leads; said electrical conductors are connected with said at least four leads in a predetermined four phase configuration.

8. The apparatus of claim 7 wherein said four phase current source has five leads that also include a neutral voltage lead and said electrical conductors are connected with said five leads in a predetermined modified four phase configuration.

9. The apparatus of claim 5 wherein said multiphase current source is an eight phase current source having at least eight leads; said electrical conductors are connected with said at least eight leads in a predetermined eight phase configuration.

10. The apparatus of claim 9 wherein said eight phase current source has nine terminals that also include a neutral voltage terminal and said electrical conductors are connected with said nine terminals in a predetermined modified eight phase configuration.

* * * * *